United States Patent [19]

Lutz et al.

[11] Patent Number: 4,877,700

[45] Date of Patent: Oct. 31, 1989

[54] LAYERED ELECTROPHOTOGRAPHIC RECORDING MATERIAL CONTAINING SELENIUM, ARSENIC AND BISMUTH OR TELLURIUM

[75] Inventors: Manfred Lutz; Bernd Reimer, both of Belecke, Fed. Rep. of Germany

[73] Assignee: Licentia Patent-Verwaltungs-GmbH, Frankfurt am Main, Fed. Rep. of Germany

[21] Appl. No.: 218,455

[22] Filed: Jun. 28, 1988

Related U.S. Application Data

[63] Continuation of Ser. No. 476,601, Mar. 18, 1983, abandoned, which is a continuation-in-part of Ser. No. 203,676, Nov. 3, 1980, Pat. No. 4,385,105, which is a continuation-in-part of Ser. No. 269,941, Jun. 3, 1981, Pat. No. 4,379,821.

[30] Foreign Application Priority Data

Mar. 20, 1982 [DE] Fed. Rep. of Germany ..... 3210293

[51] Int. Cl.[4] ..... G03G 5/04

[52] U.S. Cl. ..... 430/58; 430/84; 430/945

[58] Field of Search ..... 430/57, 84, 85, 86

[56] References Cited

U.S. PATENT DOCUMENTS

| | | | |
|---|---|---|---|
| 2,803,542 | 7/1955 | Ullrich, Jr. | 430/85 |
| 3,712,810 | 12/1970 | Ciuffini | 430/57 |
| 4,220,696 | 9/1980 | Tanaka et al. | 430/57 |
| 4,277,551 | 7/1981 | Sonnonstine et al. | 430/85 X |
| 4,296,191 | 10/1981 | Jacobson et al. | 430/57 |
| 4,379,821 | 4/1983 | Lutz et al. | 430/84 X |
| 4,385,105 | 5/1983 | Lutz et al. | 430/84 X |

FOREIGN PATENT DOCUMENTS

| | | |
|---|---|---|
| 2248054 | 12/1974 | Fed. Rep. of Germany . |
| 1597882 | 4/1977 | Fed. Rep. of Germany . |
| 2945309 | 3/1981 | Fed. Rep. of Germany . |
| 3020938 | 10/1981 | Fed. Rep. of Germany . |
| 3020939 | 12/1982 | Fed. Rep. of Germany . |
| 3210293 | 8/1985 | Fed. Rep. of Germany . |
| 7064741 | 4/1982 | Japan . |

*Primary Examiner*—J. David Welsh

*Attorney, Agent, or Firm*—Spencer & Frank

[57] ABSTRACT

An electrophotographic recording material comprises a dual photoconductive layer applied to an electrically conductive substrate. The lower layer disposed on the substrate is made of an amorphous system of selenium and arsenic containing 18 to 37 percent by weight arsenic. The layer thereabove is made of $As_{2-x}Bi_xSe_3$ or $As_2Se_{3-y}Te_y$. The recording material is highly sensitive in the visible spectral range as well as in the IR range and can therefore also be used for recordings with solid state laser diode radiation. In cyclic operation, the material exhibits only slight fatigue.

14 Claims, 1 Drawing Sheet

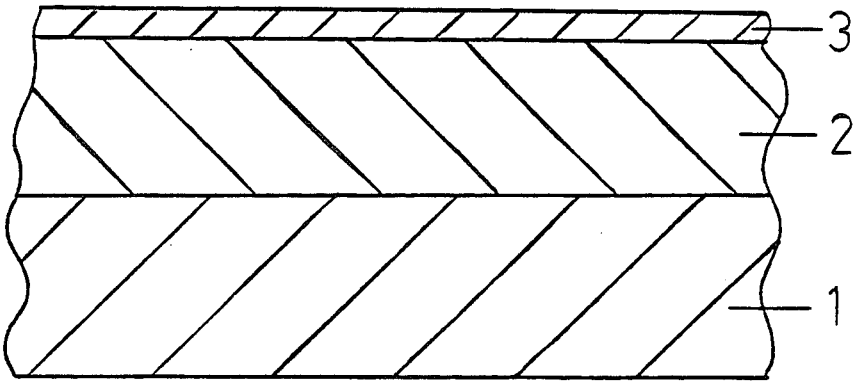
3
2
1

LAYERED ELECTROPHOTOGRAPHIC RECORDING MATERIAL CONTAINING SELENIUM, ARSENIC AND BISMUTH OR TELLURIUM

CROSS-REFERENCE TO RELATED APPLICATIONS

This application is a continuation of U.S. application Ser. No. 06/476,601, filed Mar. 18, 1983, now abondoned, which is a continuation-in-part of U.S. application Ser. No. 203,676 filed Nov. 3, 1980now U.S. Pat. No. 4,385,105, and is also a continuation-in-part of U.S. appplication Ser. No. 269,941, filed June 3, 1981now U.S. Pat. No. 4,379,821.

BACKGROUND OF THE INVENTION

The present invention relates to an electrophotographic recording material including a dual photoconductive layer applied to and electrically conductive substrate, with each one of the two photoconductive layers in the dual layer containing selenium. The dual layer contains a lower photoconductive layer disposed on the substrate and made of an amorphous system comprising arsenic and selenium and an upper photoconductive layer which is made of $As_{2-x}Bi_xSe_3$ or of $As_2Se_{3-y}Te_y$.

Electrophotographic recording materials are used for electrophotographic copying processes which have found wide application in the photocopying art. Such processes are based on the property of the photoconductive material to change its electrical resistance when exposed to an activating radiation.

After a photoconductive layer has been electrically charged and exposed to an activating radiation in a pattern corresponding to an optical image, a latent electrical charge image, which corresponds to the optical image, is produced on the photoconductive layer. At the exposed locations, the conductivity of the photoconductive layer is increased to such an extent that the electric charge can flow off, at least in part, through the conductive substrate, but in any event the flow-off is at a greater extent at the exposed locations than at the unexposed locations. At the unexposed locations, the electric charge should remain essentially intact, and the pattern of the charge can then be made visible by means of an image powder, a so-called toner. The resulting toner image, if necessary, can then be transferred to paper or a similar record carrier. Electrophotographically active substances which have been employed include organic as well as inorganic substances. Among the inorganic substances which have been used, selenium, selenium alloys and compounds with selenium have gained particular significance. They play an important role particularly in their amorphous state and have found many uses in practice.

The change in the electrical conductivity of a photoconductor depends on the intensity and the wavelength of the radiation employed. Within the range of visible light which is preferred for practical use in electrophotography, for example, in office copiers, the amorphous selenium exhibits high sensitivity on the blue side, i.e. in the shortwave range, whereas on the red side, i.e. in the longwave range, it exhibits very low sensitivity.

The result is that a red character is reproduced on an electrophotographic plate in the same manner as a black character, which under certain circumstances, particularly with colored masters, may present practical disadvantage, since a black character on a red background—or vice versa —will not be distinguishable from its background and cannot, therefore, be made visible. For wavelengths in the infrared range, amorphous selenium is not suitable at all.

However, those are the sensitivity ranges which are desirable if electrophotography is also to be used to advantage for other purposes, for example for recordings made with laser radiation.

It is known that data output devices use IR solid state lasers which operate as radiation sources. Compared to gas lasers, IR solid state lasers have the advantage of direct modulation of the light emission via the diode current and they are additionally distinguished by a relatively low price. For that reason it is desirable, even preferred, to use solid state lasers. Since, however, solid state lasers emit only in a spectral range starting at about 760 nm, i.e. in a spectral range in which most of the photoconductors customarily used in electrophotography have only slight absorption and, correspondingly, only slight photosensitivity, and since the reduced photosensitivity of the photoconductors can be compensated only in part by the higher intensity of the laser radiation, electrophotography can be used expediently and advantageously for recordings made with laser radiation only if the sensitivity of the photoconductors can be extended into the IR range.

It is known that, in contrdistinction to amorphous selenium, crystallized selenium is red sensitive. Therefore if crystallized selenium is used, this part of the visible spectrum can also be utilized. However, the high dark conductivity of crystallized selenium, i.e. its characteristic of conducting electrical current very well already in the unexposed state so that a charge applied to its surface cannot be held for the length of time required for electrophotographic purposes, speaks against the use of crystallized selenium for such electrophotographic purposes.

It is also known, for example from DE-AS 2,248,054 and DE-AS 1,597,882 that spectral sensitivity can be extended into the longer wave spectral range by adding substances such as arsenic and/or tellurium to the selenium. A system made of selenium and tellurium, however, has the drawback that it is more difficult to homogeneously evaporate these materials in the form of an alloy. Moreover, with higher tellurium concentrations, the photoconductive layer exhibits an undesirable tendency to crystallize and thus has only a short service life.

DE-OS 30 20 938, DE-OS 30 20 939, and U.S. application Ser. No. 06/269,941, filed on June 3rd, 1981 and corresponding to DE OS 30 20 939, disclose dual layer structures in which the lower layer is made of amorphous arsenic selenide. The upper layer on top of this arsenic selenide layer is made of a compound of arsenic, bismuth and selenium of the general formula $As_{2-x}Bi_xSe_3$ with x values between $0.01 \leqq x \leqq 0.5$, or of a compound of arsenic, selenium and tellurium of the general formula $As_2Se_{3-y}Te_y$ with y values between $0.05 \leqq y \leqq 2.5$. These dual photoconductor layers comprising a lower charge carrier transporting layer and an upper charge carrier generating layer exhibit a noticeable and practically utilizable sensitivity extending into a wavelength range of more than 800 nm.

The realization of a particularly high photosensitivity which extends into the IR range, however, brings with it a certain fatigue of the photoconductor material, i.e.

an increase in dark discharges and a connected reduction of the charging potential under cyclical stress.

It can be assumed that the occurrence of fatigue under cyclical stress is a direct result of the extremely poor mobility of the electrons in the photoconductive material. As a consequence of this poor mobility, negative space charge zones build up in the interior of the photoconductor near its exposed surface and these space charge zones cause increased injection of positive surface changes so that the above-mentioned reduction in charging potential becomes evident as a loss of contrast in the printed image. This effect is somewhat augmented if, for the purpose of expanding the sensitivity range, the photoconductor contains tellurium or bismuth or antimony.

It is possible, by means of suitable measures, to sufficiently stabilize the charging potential even under continued cyclical stress, for example by selecting an erase light system whose spectral emission is set in such a way that it stabilizes the density of the space charge, and/or by the use of charging devices, such as the Scorotron, which keeps the surface potential constant.

This stabilization, however, applies only as long as light is used which comes from a radiation source that is greatly absorbed by the photoconductors so that photoelectric electrons are generated only in an extremely thin zone closely below the exposed surface of the photoconductor. These electrons produce the photodischarge of the positive surface charge and thus do not contribute to a change or buildup of space charges in the interior of the photoconductor.

If, however, light is used for which the photoconductors have less absorption capability, electron-hole pairs are formed not only immediately below the surface but also in the interior of the photoconductor. Corresponding to their positive charge, the holes travel to the substrate while the electrons, due to their very poor mobility, build up space charges at the illuminated locations in the interior of the photoconductor, with these space charges depending on the intensity and areal expanse of the illuminated regions. As a consequence, additional fatigue occurs in dependence on intensity and location.

SUMMARY OF THE INVENTION

It is an object of the present invention, to provide an electrophotographic recording material which is as panchromatic as possible, whose photoconductor is highly sensitive in the range of visible light as well as in the IR range so that it can be used in conventional office copiers as well as, for example, in data output devices operated with solid state laser radiation.

It is a further object of the present invention to provide a photoconductor which represents a mechanically hard and thermally stable system, thus assuring long service life.

Another object of the present invention is to provide such a photoconductor which has a low dark discharge at the same IR sensitivity as the above mentioned dual layers, and moreover which is distinguished by low fatigue so that no worsening of the electrophotographic values occurs even in cyclic operation.

Additional objects and advantages of the present invention will be set forth in part in the description which follows and in part will be obvious from the description or can be learned by practice of the invention. The objects and advantages are achieved by means of the articles, products, instrumentalities and combinations particularly pointed out in the appended claims.

To achieve the foregoing objects and in accordance with its purpose, the present invention provides an electrophotographic recording material comprising a dual photoconductive layer applied to an electrically conductive substrate, with each one of the two photoconductive layers in the dual layer containing selenium, with the dual layer containing a lower photoconductive layer disposed on the substrate and which is an amorphous system of arsenic and selenium, and an upper photoconductive layer which is made of $As_{2-x}Bi_xSe_3$ or of $As_2Se_{3-y}Te_y$, where $0<x<2$ or $0<y3$, and wherein, according to the present invention, the lower photoconductive layer disposed on the substrate is made of selenium and 18 to 37 percent by weight arsenic.

Preferably, the lower photoconductive layer disposed on the substrate contains 30 to 35 percent by weight arsenic. The weight percentages of arsenic referred to herein are based on the total weight of the lower layer.

The thickness of the lower photoconductive layer disposed on the substrate generally can be 20 to 100μ, preferably 50 to 70μ. For the upper photoconductive layer of $As_{2-x}Bi_xSe_3$ or $As_2Se_{3-y}Te_y$ a thickness of 0.3 to 10μ, preferably 1 to 5μ, is of advantage.

When $As_{2-x}Bi_xSe_3$ is used as the upper photoconductive layer, the x value generally is in a range of $0.01 \leqq x \leqq 0.5$, preferably in a range of $0.05 \leqq x \leqq 0.2$. If $As_2Se_{3-y}Te_y$ is used as the upper layer, the y value generally is in a range of $0.05 \leqq y \leqq 2.5$, preferably in a range of $0.1 \leqq y \leqq 0.5$.

By utilizing the present invention, the electrophotographic recording material can be used to advantage, in addition to the known applications, in applications which require sensitivity in wavelength ranges over 800 nm, for example, 810 nm to 850 nm and up to about 950 nm. Thus, new fields of application are opened for electrophotography, for example, recording with laser diode radiation.

Moreover, the dual photoconductive layer of the present invention has the further special advantage that the charge carrier generating layer, namely, the upper layer of $As_{2-x}Bi_xSe_3$ or of $As_2Se_{3-y}Te_y$, and the charge carrier transporting layer, namely the lower layer of selenium containing 18 to 37 percent by weight arsenic, can be individually adapted to all deisred conditions and can be optimized. Compared to known dual photoconductor layers, the recording material according to the present invention is additionally distinguished in that there is no or only very slight fatigue.

The dual photoconductive layer can be disposed directly on the substrate with its lower layer in contact with the substrate, and the electrophotographic recording material can contain only the substrate and the dual layer of the present invention.

In one preferred embodiment of the present invention, an intermediate layer is disposed between the electrically conductive substrate and the dual photoconductive layer, so that the portion of the incident light not absorbed in the beam path is absorbed before it impinges on the substrate. The intermediate layer is preferably made of one or more of the metals like Cd, Ga, In, Tl, Sn, Pb, Te or Mn by vacuum evaporation with a layer thickness of 10 to 2000 nm. Alternative to or in conjunction with the use of intermediate layer, the surface of the substrate on which there is disposed the dual photoconductive layer is roughened so that the portion of the incident light which is not absorbed is diffused.

With the above measure of employing an intermediate layer and/or roughening the surface of the substrate, there are no reflections of incident light not absorbed in the photoconductor at the surface of the substrate. The above measures also prevent interference between incident and reflected light which could develop, for example, if laser radiation of a narrow spectral bandwidth were used and which would then appear in the printed image as annoying interference structures.

BRIEF DESCRIPTION OF THE DRAWINGS

The sole FIG. of the drawing is a schematic cross-sectional view of an electrophotographic recording material produced in accordance with one embodiment of the present invention.

DETAILED DESCRIPTION OF THE INVENTION

The electrophotographic recording material according to the present invention can be produced according to conventional methods. For example, the dual photoconductive layer can be produced by appling both layers to the electrically conductive substrate under a pressure of about $p=10^{-4}$ mbar, with the aid of a vapor deposition process. Once a pressure of about $p=10^{-2}$ nbar has been reached in a vacuum system, the substrate which is preferably made of aluminum, is cleaned by way of a glow discharge and is then heated to a temperature of about 220° C. Then, under a pressure of about $p=10^{-4}$ mbar, and alloy of selenium and 30 weight percent arsenic is vapor-deposited from a first evaporator whose temperature is 390° to 400° C.

The ingredients are measured out in an amount such that a layer thickness of about 60μ is realized upon complete evaporation of the ingredients which have been weighed in the first evaporator. The intended layer thickness can be checked during the vapor-deposition process by means of a layer thickness gauge.

Thereafter, a second evaporator is brought to a temperature of about 420° C. and an arsenic selenide telluride ($As_2Se_{2.7}Te_{0.3}$) is applied to the initially deposited layer, likewise by complete evaporation of the entire amount which has placed been placed in the second evaporator. The ingredients are measured out in an amount such that the thickness of the upper layer will be about 5μ.

After cooling, an electrophotographic recording material is obtained which is a highly sensitive panchromatic photoconductor exhibiting only slight fatigue which, even after several thousand copying cycles, is still distinguished by stable charging potential values. With a charging potential of $V_0=+800$ V, and illumination with light of a wavelength of $\lambda=800$ nm and a light intensity of 1 $\mu J/cm^2$ (microjoule/$cm^2$), there results a contrast potential of about 550 V.

Referring now to the drawing, there is shown one embodiment of a layer structure for the recording material according to the present invention. On an electrically conductive substrate 1, advisably made of aluminum or of metallized plastic, a first photoconductive layer 2 of selenium containing 30 weight percent arsenic is applied directly to the substrate to a layer thickness of 20 to 100μ. A sencond photoconductive layer 3 whose composition corresponds to the formula $As_2Se_{2.7}Te_{0.3}$ and whose layer thickness is 0.5 to 10μ is disposed on top of this lower photoconductive layer 2.

It will be understood that the above description of the present invention is susceptible to various modifications, changes and adaptations, and the same are intended to be comprehended within the meaning and range of equivalents of the appended claims.

What is claimed is:

1. Fatigue resistant electrophotographic recording material having a high photosensitivity which extends into the infrared range containing a dual photoconductive layer applied to an electrically conductive substrate, with each of the two photoconductive layers of the dual layer containing selenium, the dual layer consisting of a lower photoconductive layer disposed of the substrate, said lower layer consisting of an amorphous system of arsenic and selenium, and an upper photoconductive layer made of $As_{2-x}Bi_xSe_3$ or of $As_2Se_{3-y}Te_y$, where $0<x<2$ or $0<y<3$, and wherein the lower photoconductive layer disposed on the substrate is made of selenium containing arsenic in the less than stoichiometric amount of from 18 to 37 precent by weight, whereby increasing dark discharges and decreasing charging potential caused by cyclic stress fatigue are avoided.

2. Electrophotographic recording material as defined in claim 1, wherein the thickness of the lower layer disposed on the substrate is 20 to 100μ.

3. Electrophotographic recording material as defined in claim 1, wherein the thickness of the lower layer disposed on the substrate is 50 to 70μ.

4. Electrophotographic recording material as defined in claim 1, wherein the thickness of the upper layer is 0.3 to 10μ.

5. Electrophotographic recording material as defined in claim 1, wherein the thickness of the upper layer is 1 to 5μ.

6. Electrophotographic recording material as defined in claim 1, wherein $As_{2-x}Bi_xSe_3$ is employed as the upper layer, and the x value is in a range of $0.01 \leqq x \leqq 0.5$.

7. Electrophographic recording material as defined in claim 6, wherein the x value is in a range of $0.05 \leqq x \leqq 0.2$.

8. Electrophographic recording material as defined in claim 1, wherein $As_2Se_{3-y}Te_y$ is employed as the upper layer, and the y values is in a range of $0.05 \leqq y \leqq 2.5$.

9. Electrophotographic recording material as defined in claim 8, wherein the y value is in a range of $0.1 \leqq y \leqq 0.5$.

10. Electorphotographic recording material as defined in claim 1, wherein an intermediate layer is disposed between the conductive substrate and the dual photoconductive layer, said intermediate layer absorbing the portion of the incident light not absorbed in the beam path before said light impinges on the substrate.

11. Electrophotographic recording material as defined in claim 1, wherein the surface of the conductive substrate, on which there is disposed the dual photoconductive layer, is roughened.

12. Electrophotographic recording material as defined in claim 10, wherein the surface of the conductive substrate, on which there is disposed the intermediate layer and dual photoconductive layer, is roughened.

13. A method of recording with solid state laser diode radiation in a spectrum range up to about 950 nm, by directing the radiation onto an electrophotographic recording material as defined in claim 1.

14. Fatigue resistant electrophotographic recording material having a high photosensitivity which extends into the infrared range containing a dual photoconductive layer applied to an electrically conductive substrate, with each of the two photoconductive layers of the dual layer containing selenium, the dual layer consisting of a lower photoconductive layer disposed on the substrate, said lower layer consisting of an amorphous system of arsenic and selenium, and an upper photoconductive layer made of $As_{2-x}Bi_xSe_3$ or of $As_2Se_{3-y}Te_y$, where $0<x<2$ or $0<y<3$, and wherein the lower photoconductive layer disposed on the substrate is made of selenium containing arsenic in the less than stoichiometric amount of from 30 to 35 precent by weight, whereby increasing dark discharges and decreasing charging potential caused by cyclic stress fatigue are avoided.

* * * * *

UNITED STATES PATENT AND TRADEMARK OFFICE

CERTIFICATE OF CORRECTION

PATENT NO. : 4,877,700

DATED : October 31, 1989

INVENTOR(S) : Manfred Lutz and Bernd Reimer

It is certified that error appears in the above-identified patent and that said Letters Patent is hereby corrected as shown below:

The term of this patent subsequent to April 12, 2000, has been disclaimed.

Signed and Sealed this

Sixth Day of November, 1990

*Attest:*

HARRY F. MANBECK, JR.

*Attesting Officer*

*Commissioner of Patents and Trademarks*